US007485074B2

(12) United States Patent
Chen

(10) Patent No.: US 7,485,074 B2
(45) Date of Patent: Feb. 3, 2009

(54) ANKLE THERAPY APPARATUS

(76) Inventor: Zhi-Ting Chen, No. 114, Lungyen Rd., Changhua City (TW)

( * ) Notice: Subject to any disclaimer, the term of this patent is extended or adjusted under 35 U.S.C. 154(b) by 0 days.

(21) Appl. No.: 11/790,704

(22) Filed: Apr. 27, 2007

(65) Prior Publication Data

US 2008/0269027 A1 Oct. 30, 2008

(51) Int. Cl.
*A63B 23/08* (2006.01)
*A63B 23/10* (2006.01)

(52) U.S. Cl. ..... 482/80; 482/79

(58) Field of Classification Search ..... 482/79, 482/80

See application file for complete search history.

(56) References Cited

U.S. PATENT DOCUMENTS 3,713,438 A * 1/1973 Knutsen ..... 601/35

* cited by examiner

*Primary Examiner*—Lori Amerson
(74) *Attorney, Agent, or Firm*—Rosenberg, Klein & Lee

(57) ABSTRACT

An ankle therapy apparatus in which a reversible motor is mounted on a support at a rotary table in a base frame to rotate a gear transmission mechanism and a footplate is pivoted to the support and coupled to the gear transmission mechanism and turned alternatively upwards and downwards during operation of the reversible motor, and a clutch gear is selectively set to couple the gear transmission mechanism to the rotary table for causing rotation of the rotary table during the motion of the footplate.

2 Claims, 5 Drawing Sheets

ANKLE THERAPY APPARATUS

BACKGROUND OF THE INVENTION

1. Field of the Invention

The present invention relates to an exercising apparatus for physical therapy and more particularly, to an ankle therapy apparatus.

2. Description of the Related Art

The rehabilitation of the ankle needs to turn the joint between the foot and the leg alternatively upward and downward as well as leftward and rightward. This treatment may be performed manually or by an electrical therapy apparatus. A conventional electrical therapy apparatus for ankle therapy can simply turn the joint between the foot and the leg alternatively upward and downward (or leftward and rightward). For leftward and rightward (or upward and downward) motion, a second ankle therapy apparatus must be used.

SUMMARY OF THE INVENTION

The present invention has been accomplished under the circumstances in view. It is one object of the present invention to provide an ankle therapy apparatus, which can turn the ankle joint alternatively upward and downward as well as leftward and rightward.

To achieve this and other objects of the present invention, the ankle therapy apparatus comprises a base frame, the base frame comprising an upright pivot axle and an arched rack at a top side thereof; a rotary table pivotally supported on he pivot axle, the rotary table having a support member fixedly provided at a top side thereof; a reversible motor supported on support member; a gear transmission mechanism supported on the support member and coupled to and rotatable by the reversible motor, the gear transmission mechanism comprising an output shaft and an output gear fixedly mounted on the output shaft; a clutch gear slidably mounted on the output shaft and rotatable with the output shaft and axially movable along the output shaft between a first position where the clutch gear is meshed with the arched rack for causing rotation of the rotary table relative to the base frame upon operation of the reversible motor, and a second position where the clutch gear is disengaged from the arched rack; a footplate pivoted to the support member, the footplate having a driven gear fixedly provided at a bottom side thereof and meshed with the output gear.

DETAILED DESCRIPTION OF THE PREFERRED EMBODIMENT

Figure 1:
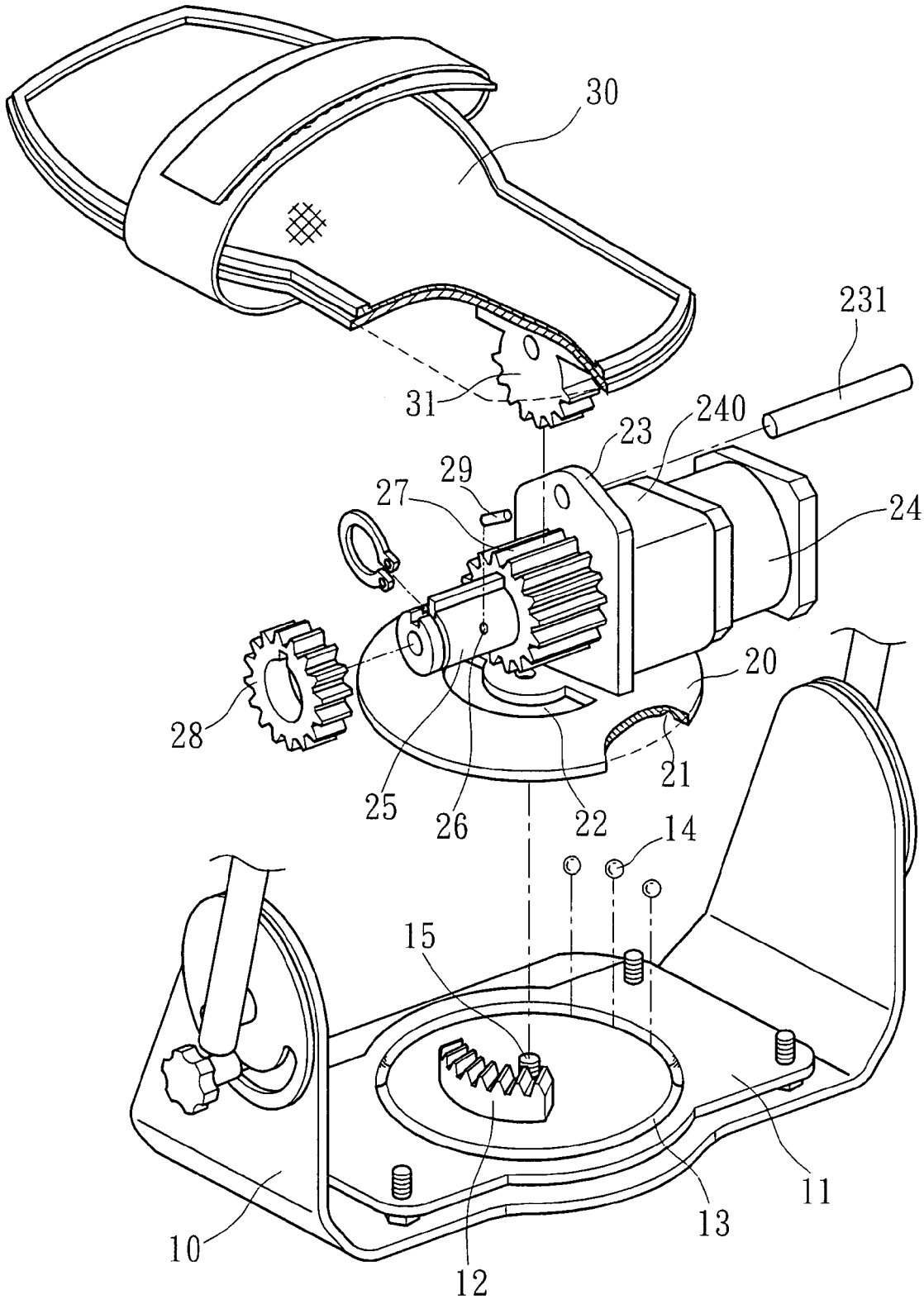
FIG. 1 is an exploded view of an ankle therapy apparatus according to the present invention.
Figure 2:
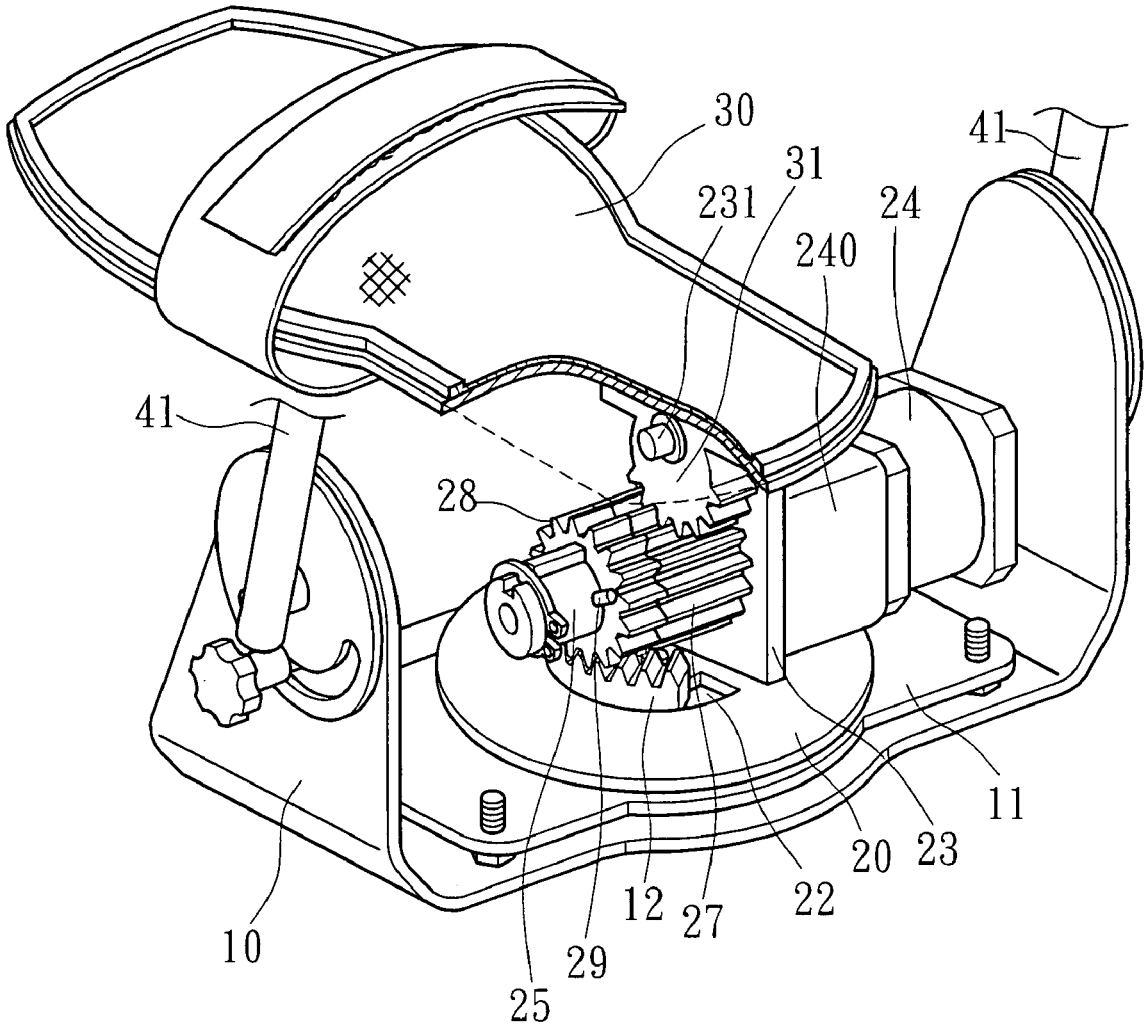
FIG. 2 is a cutaway view of the ankle therapy apparatus according to the present invention.

Referring to FIGS. 1~5, an ankle therapy apparatus in accordance with the present invention is shown comprising a base frame 10, a bottom plate 11 fixedly mounted in the base frame 10, an arched rack 12 fixedly mounted on the top side of the bottom plate 11 near one side, a pivot axle 15 fixedly fastened to and vertically upwardly extending from the center of the top side of the bottom plate 11, and a rotary table 20 pivotally supported on the pivot axle 15. The rotary table 20 has an arched border opening 22 corresponding to the arched rack 12, a support 23 at the top side to support a reversible motor 24 and a gear transmission mechanism 240. The gear transmission mechanism 240 is coupled to the reversible motor 24 and rotatably by the reversible motor 24, having an output shaft 25, an output gear 27 fixedly mounted on the output shaft 25, and a clutch gear 28 slidably mounted on the output shaft 25 and axially movable along the output shaft 25 between a first position where the clutch gear 28 is meshed with the arched rack 12, and a second position where the clutch gear 28 is disengaged from the arched rack 12. A lock pin 29 may be fastened to a pin hole 26 on the output shaft 25 to lock the clutch gear 28 to the output shaft 25. The ankle therapy apparatus further comprises a footplate 30. The footplate 30 is turnable about a pivot 231 at the support 23, having a driven gear 31 fixedly provided at the bottom side and meshed with the output gear 27. Further, circular ball tracks 13 and 21 are respectively provided at the top side of the bottom plate 11 and the bottom side of the rotary table 20. Steel balls 14 are set in between the circular ball tracks 13 and 21 and movable therein to support rotary motion of the rotary table 20 on the bottom plate 11.

Figure 3:
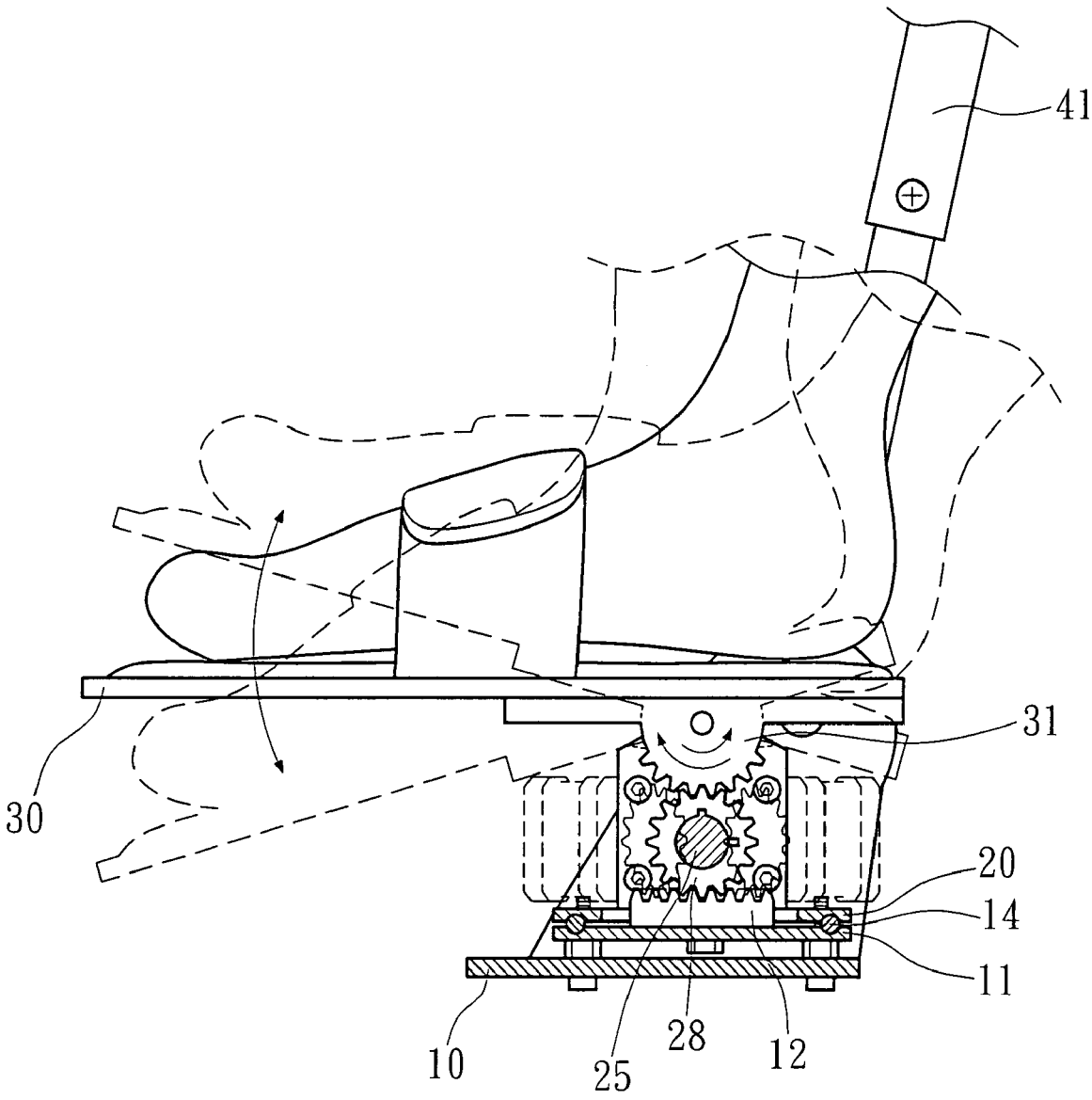
FIG. 3 is a schematic drawing showing one operation mode of the ankle therapy apparatus according to the present invention.
Figure 4:
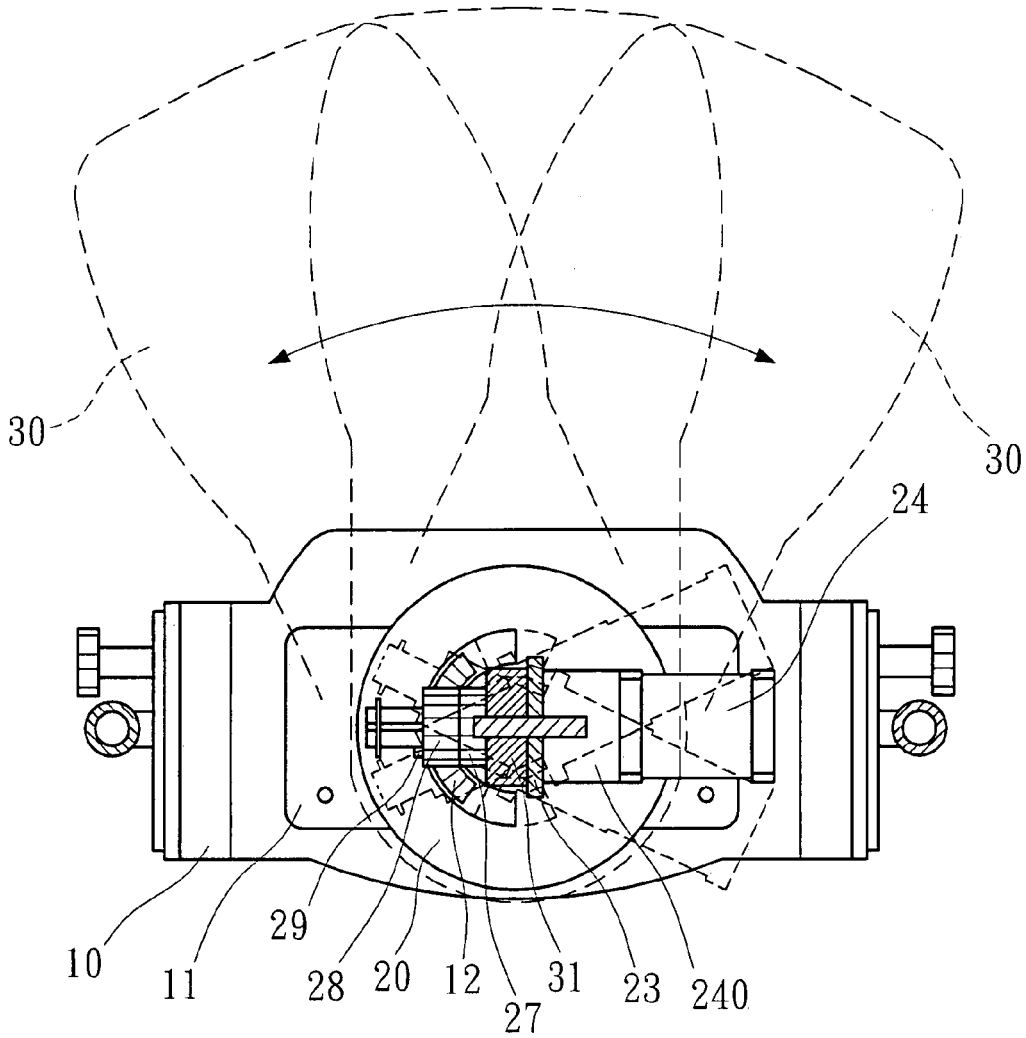
FIG. 4 is a schematic drawing showing another operation mode of the ankle therapy apparatus according to the present invention.

Referring to FIGS. 3 and 4, the user's foot is put in the footplate 30, and then the reversible motor 24 is started to rotate the output shaft 25 forwards and backwards alternatively at a predetermined speed, causing the output gear 27 to rotate the driven gear 31, and therefore the footplate 30 is driven to turn the user's foot upwards and downwards in vertical direction. Because the clutch gear 28 is meshed with the arched rack 12 at this time, the rotary table 20 is rotated leftwards and rightwards in horizontal direction as the user's foot is turned with the footplate 30 alternatively forwards and backwards.

Figure 5:
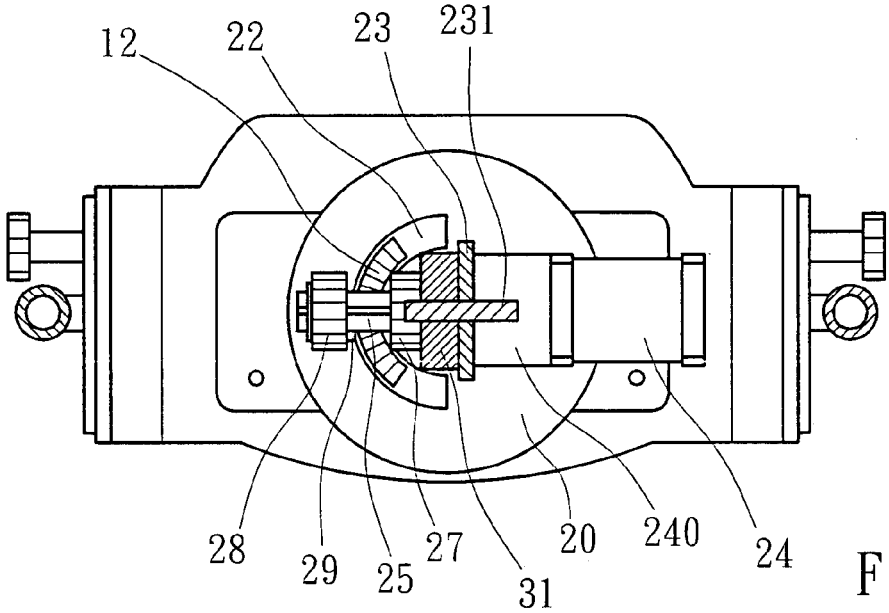
FIG. 5 is a top view of the present invention, showing the clutch gear disengaged from the arched rack.

Referring to FIG. 5, the user can disengage the clutch gear 28 from the arched rack 12. At this time, the rotary table 20 stands still when the user's foot is turned with the footplate 30 alternatively forwards and backwards.

Figure 6:
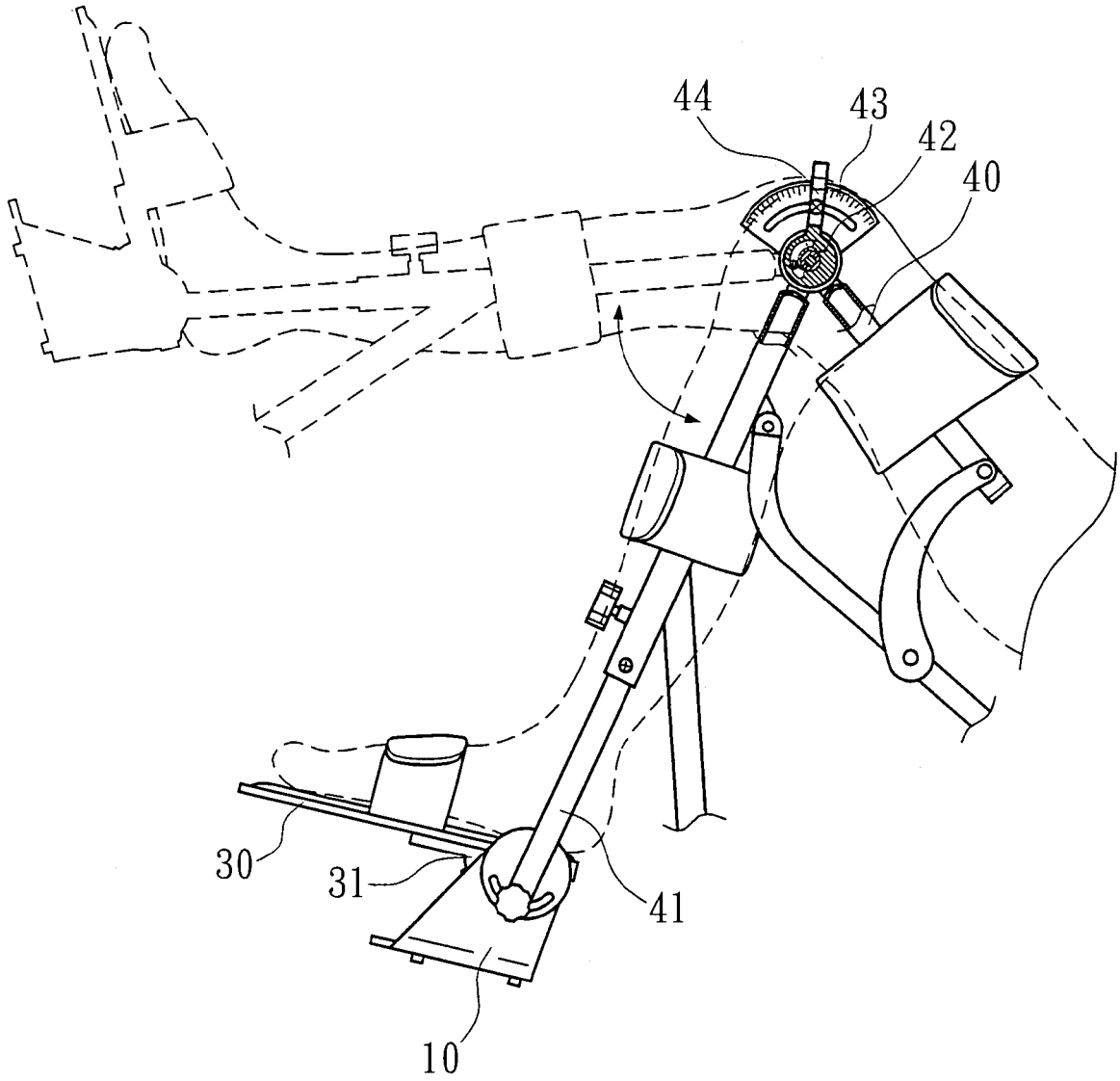
FIG. 6 is a schematic drawing showing an application example of the ankle therapy apparatus.

Referring to FIG. 6, the base frame 10 is fixedly fastened to the bottom side of a shank frame 41, which is pivoted to a thigh frame 40 by a pivot joint 42. The pivot joint 42 is provided with an angle scale 43 and an angle-setting member 44 for setting the turning angle of the shank frame 41 relative to the thigh frame 40. When in use, the foot of the leg is put in the footplate 30, and then the shank and thigh of the leg are respectively secured to the shank frame 41 and the thigh frame 40. Thus, the user can turn the shank alternatively forwards and backwards during the operation of the ankle therapy apparatus.

Although particular embodiments of the invention have been described in detail for purposes of illustration, various modifications and enhancements may be made without departing from the spirit and scope of the invention. Accordingly, the invention is not to be limited except as by the appended claims What the invention claimed is:

1. An ankle therapy apparatus, comprising:

a base frame, said base frame including an upright pivot axle and an arched rack at a top side thereof;

a rotary table pivotally supported on said pivot axle, said rotary table having a support member fixedly provided at a top side thereof;

a reversible motor supported on said support member;

a gear transmission mechanism supported on said support member and coupled to and rotatable by said reversible motor, said gear transmission mechanism comprising an output shaft and an output gear fixedly mounted on said output shaft;

a clutch gear slidably mounted on said output shaft and rotatable with said output shaft and axially movable along the output shaft between a first position where said clutch gear is meshed with said arched rack for causing rotation of said rotary table relative to said base frame upon operation of said reversible motor, and a second position where said clutch gear is disengaged from said arched rack;

a footplate pivoted to said support member, said footplate having a driven gear fixedly provided at a bottom side thereof and meshed with said output gear, wherein, upon actuation of said reversible motor, the engagement of said driven gear on said footplate with said output gear on said output shaft produces a pivoting motion of said footplate about an axle of said output shaft in a first plane, and wherein the engagement of said clutch gear with said arched rack in said first position of said clutch gear produces a pivoting motion of said footplate about said pivot axle positioned on said base frame in a second plane substantially perpendicular to said first plane.

2. The ankle therapy apparatus as claimed in claim 1, further comprising a bearing means to support rotation of said rotary table on said base frame, said bearing means comprises a first circular ball track provided at said base frame, a second circular ball track provided at a bottom side of said rotary table, and a plurality of steel balls movably supported in between said first circular ball track and said second circular ball track.

* * * * *